US007581515B2

(12) United States Patent
O'Connor

(10) Patent No.: US 7,581,515 B2
(45) Date of Patent: Sep. 1, 2009

(54) CONTROL SCHEME FOR AN EVAPORATOR OPERATING AT CONDITIONS APPROACHING THERMODYNAMIC LIMITS

(75) Inventor: Edward W. O'Connor, East Hampton, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 33 days.

(21) Appl. No.: 11/770,785

(22) Filed: Jun. 29, 2007

(65) Prior Publication Data

US 2009/0000772 A1 Jan. 1, 2009

(51) Int. Cl.
*F28D 15/02* (2006.01)
*F28D 15/06* (2006.01)

(52) U.S. Cl. ..... 122/31.1; 165/104.19; 165/104.11

(58) Field of Classification Search ..... 122/1 B, 122/31.1, 406.1; 165/104.11–104.19
See application file for complete search history.

(56) References Cited

U.S. PATENT DOCUMENTS 3,763,014 A 10/1973 Barba et al.
4,007,601 A 2/1977 Webbon
4,207,749 A 6/1980 Lavigne, Jr.
4,292,135 A 9/1981 Klaren
4,365,661 A 12/1982 Tripodi
4,405,348 A 9/1983 Pasternack
4,487,031 A 12/1984 Rogers et al.
4,758,385 A 7/1988 Acker et al.
4,843,824 A * 7/1989 Mushines ..... 60/667
4,934,160 A 6/1990 Mueller
5,046,319 A * 9/1991 Jones ..... 62/46.2
5,092,129 A 3/1992 Bayes et al.
5,347,815 A * 9/1994 Jones ..... 62/46.2
5,461,882 A 10/1995 Zywiak
5,607,011 A * 3/1997 Abdelmalek ..... 165/104.14
5,701,755 A 12/1997 Severson et al.
5,743,102 A * 4/1998 Thomas et al. ..... 62/185
5,946,931 A 9/1999 Lomax et al.
6,464,672 B1 10/2002 Buckley

* cited by examiner

*Primary Examiner*—Gregory A Wilson
(74) *Attorney, Agent, or Firm*—Carlson, Gaskey & Olds

(57) ABSTRACT

A heat exchanger assembly includes a plurality of evaporative heat exchangers that are selectively feed evaporant to tailor operation to current heat load in order to maintain operation in thermodynamically extreme operating conditions.

17 Claims, 2 Drawing Sheets

CONTROL SCHEME FOR AN EVAPORATOR OPERATING AT CONDITIONS APPROACHING THERMODYNAMIC LIMITS

BACKGROUND OF THE INVENTION

This invention generally relates to a method of controlling an evaporative heat exchanger. More particularly, this invention relates to a control scheme for operating an evaporative heat exchanger that exhausts to space vacuum.

Evaporative heat exchangers are utilized in applications where a conventional radiator cannot be utilized. An evaporative heat exchanger includes a cooling medium that accepts heat from another system and exhausts that heat to an ambient environment. Water is a very efficient cooling medium with a latent heat of 1000 BTU/lb (2326.000 J/kg). The favorable latent heat to weight ratio makes water a suitable choice for use in vehicles operating in extreme conditions with restrictive space and weight requirements.

The conditions in which evaporative heat exchangers are utilized in a space vacuum are at the extreme thermodynamic conditions for water. Slight changes in pressure and temperature can result in freezing of water within the evaporator. For this reason great care must be taken to maintain operation of the evaporative heat exchanger within desired performance ranges.

Accordingly, it is desirable to design and develop a method and device for adapting evaporative heat exchanger operation to current operating conditions to maintain desired performance.

SUMMARY OF THE INVENTION

The example heat exchanger assembly includes a plurality of evaporative heat exchangers that are selectively fed evaporant to tailor operation to current heat load in order to maintain operation in thermodynamically extreme conditions.

An example evaporative heat exchange assembly includes three evaporative heat exchangers into which is fed a heat transfer medium that carries heat from a heat generating system to an inlet. Heat rejected from the heat transfer medium is accepted by an evaporant feed separately to each of the evaporative heat exchangers. The evaporant enters each of the heat exchangers in a liquid form and vaporizes upon encountering heat given off by the heat transfer medium and is exhausted into an ambient environment.

The example heat exchanger assembly operates in the vacuum of space. The operating environment in the vacuum of space is at or near the triple point of water. At the temperatures expected during operation, water will freeze at pressures below 0.089 psia (613.6 Pa). Therefore, pressures within each of the heat exchangers must be kept above such a pressure to prevent freezing.

The temperature or heat load into the heat exchanger assembly varies during operation. Incoming heat transfer fluid at lower temperatures will not vaporize evaporant at levels encountered with higher temperatures. The resulting reduction in vaporized evaporant reduces pressure within each of the heat exchangers The example system accommodates such temperature fluctuations by tailoring heat load capacity such that pressure within each of the heat exchangers remains above the triple point pressure.

Accordingly, the example disclosed system tailors operation to provide reliable vaporization of liquid evaporant near thermodynamic limits.

These and other features of the present invention can be best understood from the following specification and drawings, the following of which is a brief description.

DETAILED DESCRIPTION OF THE PREFERRED EMBODIMENT

Figure 1:
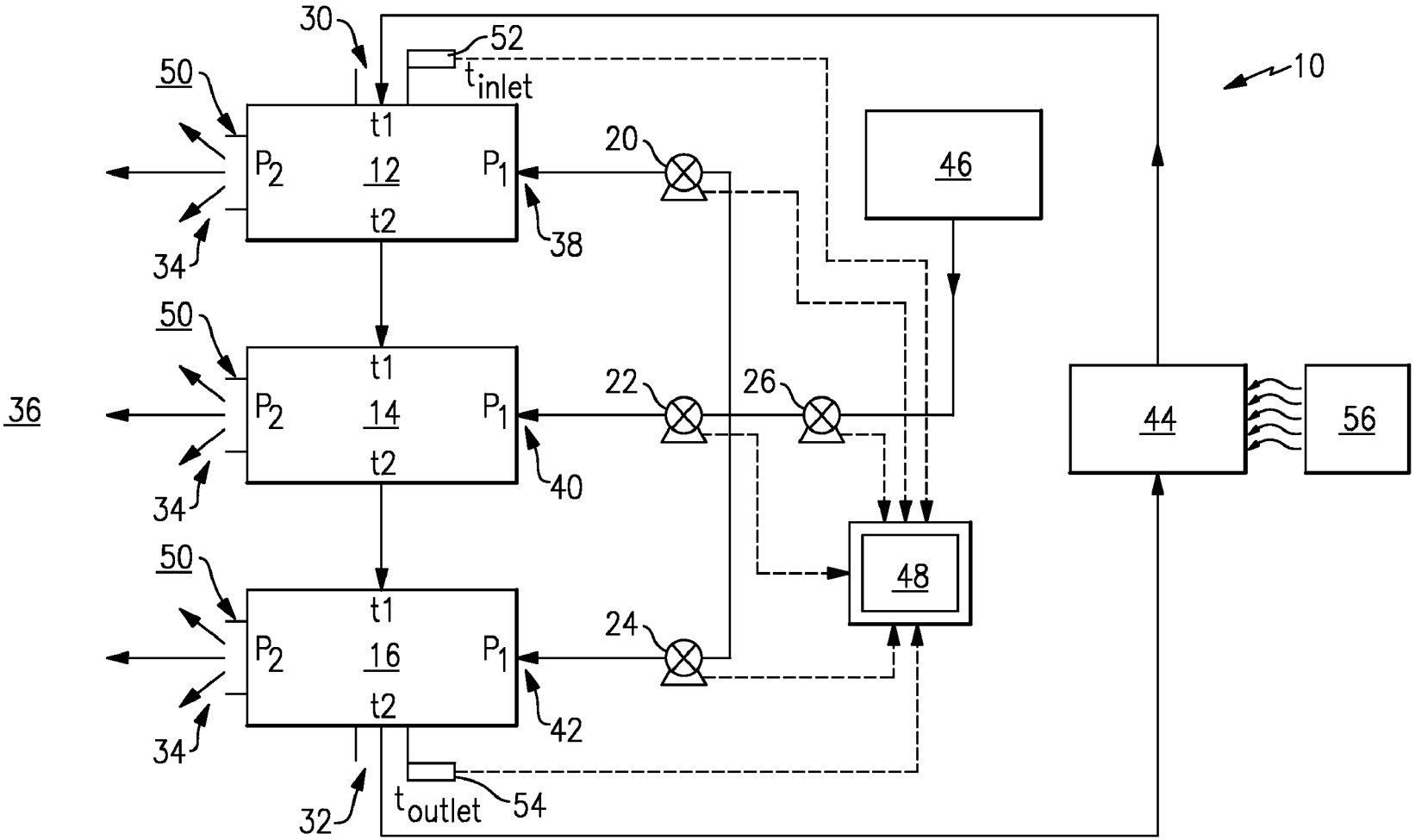
FIG. 1 is a schematic view of an example evaporative heat exchange assembly.

Referring to FIG. 1, an example evaporative heat exchange assembly 10 includes three evaporative heat exchangers 12, 14, and 16 into which is fed a heat transfer medium 44 that carries heat from a heat generating system 56 to an inlet 30 of the assembly 10. The heat transfer medium 44 flows into the inlet 30 and rejects heat to emerge from an outlet 32 at a lower temperature. The heat rejected from the heat transfer medium 44 is accepted by an evaporant 46 fed separately to each of the evaporative heat exchangers 12, 14 and 16. The evaporant 46 enters each of the heat exchangers 12, 14 and 16 in a liquid form and vaporizes upon encountering heat given off by the heat transfer medium 44. The vaporized evaporant 46 is exhausted into an ambient environment 36.

The example assembly 10 operates where the ambient environment 36 is at or near the vacuum of space. The example evaporant 46 is water as it is a weight efficient evaporant with a latent heat of 1000 BTU/lb (2326.000 J/kg). In vehicles and devices that operate in such extreme environments, weight and space must be allocated in the most efficient manner. Therefore the favorable latent heat to weight properties of water provides the desired efficiencies. However, the operating environment is at or near the triple point of water with temperatures at the relatively low temperature of around 32-36 F.° (0-2 C.°), with pressures approaching zero. At the example operating temperatures water will freeze at pressures below 0.089 psia. For this reason, pressures within each of the heat exchangers 12, 14 and 16 must be kept above such a pressure to prevent freezing.

Liquid water evaporant 46 entering each of the heat exchangers 12, 14, and 16 is vaporized by heat from the heat transfer medium 44. Each of the heat exchangers 12, 14, 16 provides for expansion of the vaporized evaporant to maintain a desired pressure above the triple point pressure. The vapor is then exhausted through exhaust ports 50 as water vapor 34. The increase in pressure caused by the vaporization of the water evaporant is utilized to maintain pressures above the triple point pressure that causes water to freeze.

As appreciated, the temperature or heat load into the heat exchanger assembly 10 varies during operation. Incoming heat transfer fluid 44 at lower temperatures will not vaporize evaporant 46 at levels encountered with higher heat transfer medium temperatures. The resulting reduction in vaporized evaporant additionally reduces pressure within each of the heat exchangers 12, 14, 16. In the environment in which the example system operates, such a reduction in pressure can result in freezing of liquid evaporant within the heat exchangers 12, 14, and 16.

The example system accommodates such temperature fluctuations by tailoring heat load capacity such that pressure within each of the heat exchangers remains above the triple point pressure. Heat load capacity is controlled by adjusting the flow of water evaporant 46 separately to each of the heat exchangers 12, 14, 16 such that the vaporization of the water evaporant produces the desired pressures at each of the outlets 50.

The assembly 10 includes valves 20, 22, and 24 selectively actuated by a controller 48 to control water evaporant 46 flow to each corresponding heat exchanger 12, 14, 16. An inlet temperature sensor 52 communicates temperature information indicative of the temperature of incoming heat transfer medium 44. An outlet temperature sensor 54 communicates information indicative of outlet temperature of the heat transfer medium. The valves 20, 22, and 24 feed evaporant through a variable control valve 26.

The heat exchangers 12, 14, and 16 are orientated to receive the heat transfer medium in series. Heat transfer medium from the first heat exchanger 12 enters the second heat exchanger 14, which in turn enters the third heat exchanger 16. Combining the heat exchangers 12, 14, 16 in series results in an overall increase in turndown capacity. In the example heat exchanger assembly, each of the evaporative heat exchangers 12, 14, 16 operate at a turndown range of 1.5:1. Combining the three provides a turndown range of 3.38:1. ((1.5*1.5*1.5) =3.38:1). When less turndown range is required due to lower temperatures of the heat transfer medium 44, one or a combination of the heat exchangers 12, 14, 16 is deactivated by closing the corresponding one of the control valves 20, 22, 24. Further, each of the heat exchangers 12, 14 and 16 can provide different turndown ranges that when operated together, or in various combinations tailor heat turndown to current conditions.

Before one of the heat exchangers 12, 14, and 16 are deactivated, the variable control valve 26 reduces flow to the currently active heat exchangers 12, 14, 16. When the reduction in evaporant flow is not sufficient to tailor operation of the heat exchanger assembly 10 to the current temperature of the incoming heat transfer medium 44, one or a combination of the heat exchangers 12, 14, and 16 are deactivated. In the disclosed example, the third heat exchanger 16 is deactivated by closing the control valve 24. Closing the control valve 24 stops the flow of evaporant 46 to the third heat exchanger 16. Accordingly, the turndown capacity is reduced. Heat transfer medium 44 still flows through the third heat exchanger 16, but no heat transfer takes place.

Operation continues at the reduced heat turndown capacity that vaporizes evaporant at levels corresponding to the reduced volume of the heat exchanger assembly 10 to maintain pressure above the triple point pressures. Further reductions in heat transfer medium temperatures are accommodated by deactivating the second heat exchanger 14 by closing off the control valve 22. The resulting reductions in heat turndown range tailors operation to maintain pressure within each of the evaporative heat exchangers 12, 14, 16 above a pressure that would cause freezing of the water evaporant.

The heat exchangers 12, 14, and 16 can be activated and deactivated in any combination to tailor the heat turndown range to current conditions. The first heat exchanger 12 and the second heat exchanger can be operated together with the third heat exchanger 16 turned off. Because each of the heat exchangers 12, 14, and 16 are independently controlled by the corresponding control valve 20, 22, and 24, many combinations of heat exchanger operation can be implanted depending on current operating conditions. Other combinations of the heat exchangers can be operated by closing off one of the corresponding control valves 20, 22, and 24.

Figure 2:
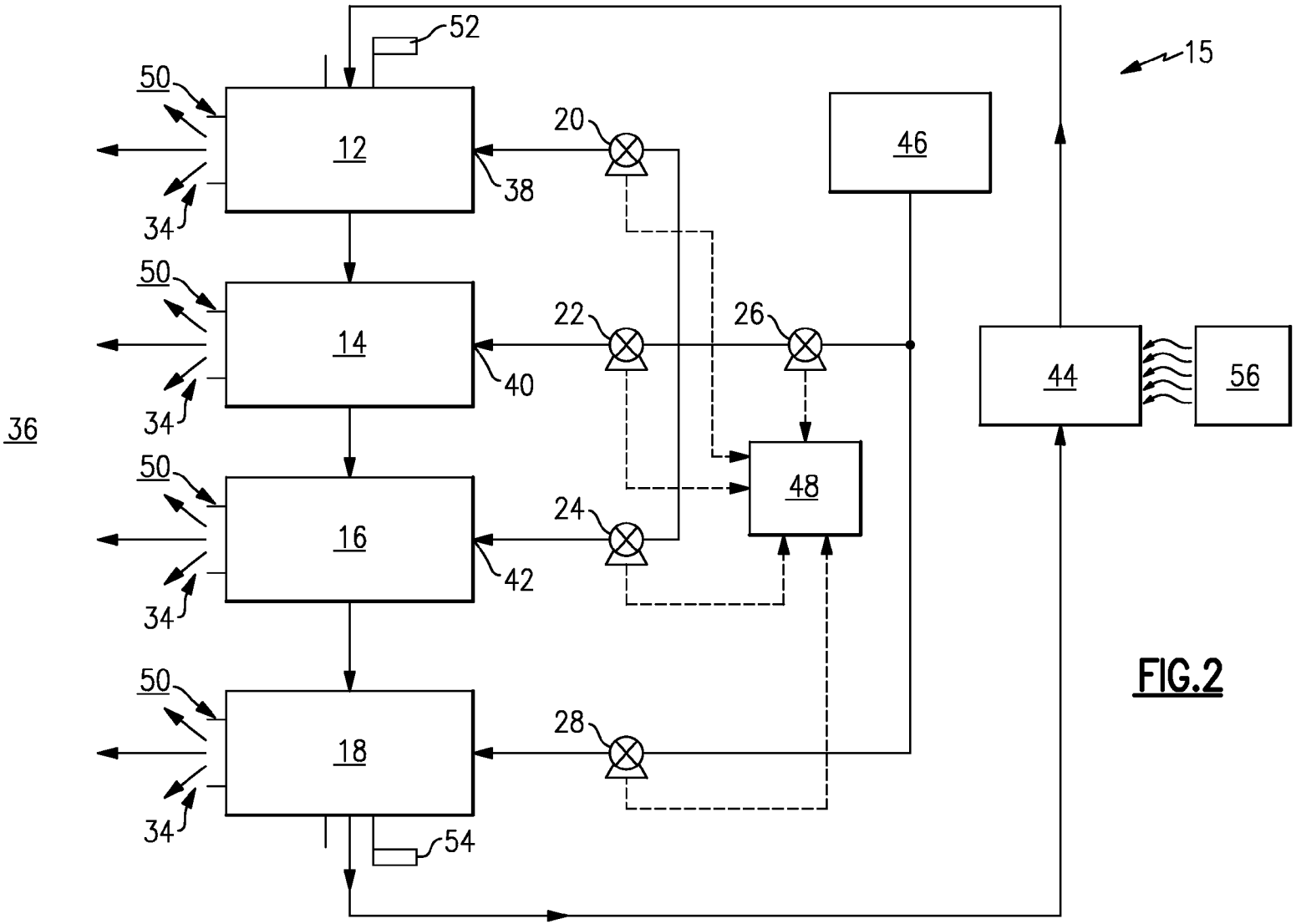
FIG. 2 is a schematic view of another example evaporative heat exchange assembly.

Referring to FIG. 2, another example heat exchange assembly 15 includes a fourth evaporative heat exchanger 18 that receives evaporant through a second variable control valve 28. In operation, the first, second and third evaporative heat exchangers 12, 14, and 16 are selectively feed liquid water evaporant 46 based on the inlet temperature of the heat transfer medium.

The fourth heat exchanger 18 provides a final turndown or temperature reduction. The fourth heat exchanger 18 reduces heat transport fluid outlet temperature to a fixed lower value. Because, the fourth heat exchanger 18 encounters a substantially constant heat load there is little temperature variation and the potential of freeze-up is mitigated. Selectively deactivating one of the first, second and third heat exchangers 12, 14, 16 provides an output of heat transport fluid 44 at a substantially constant temperature regardless of the temperature at the inlet 30. Therefore, the fourth heat exchanger 18 is not exposed to the range of temperatures that the first three heat exchangers 12, 14, 16 encounters. The second variable control valve 28 provides a sufficient range of evaporant flow to control any small fluctuation in temperature that may occur.

In the disclosed example, the heat transfer medium is also water as water is an efficient heat transfer medium relative to weight. However, other heat transfer mediums may be utilized as are dictated and desired by application specific requirements. Further, the example evaporant is water. The example system is specifically designed to take advantage of the favorable latent heat to weight properties of water. The example ambient conditions expose water to the thermodynamic extremes where small changes can result in liquid water vaporizing or freezing. Accordingly, the example disclosed system tailors operation to provide reliable vaporization of liquid water near triple point pressures.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of controlling an evaporative heat exchanger assembly comprising the steps of:

a) directing a heat carrying medium through a plurality of evaporative heat exchangers in series;

b) determining a temperature of the heat carrying medium at an inlet to the plurality of evaporative heat exchangers;

c) directing a liquid evaporant separately through each of the evaporative heat exchangers that vaporizes while accepting heat from the heat carrying medium;

d) exhausting the vaporized evaporant from each active one of the plurality of evaporative heat exchangers; and e) selectively controlling evaporant flow to each of the plurality of evaporative heat exchangers responsive to the temperature of the heat carrying medium at the inlet to mitigate potential freezing of the evaporant within each of the plurality of evaporative heat exchangers.

2. The method as recited in claim 1, wherein the step of selectively controlling each of the plurality of evaporative heat exchangers includes the step of stopping evaporant flow to at least one of the evaporative heat exchangers.

3. The method as recited in claim 1, wherein the step of exhausting evaporant includes exhausting evaporant to an ambient environment, where the ambient environment is at a condition in which the evaporant freezes.

4. The method as recited in claim 1, wherein each of the evaporative heat exchangers include an exhaust opening of a fixed non-changeable size.

5. The method as recited in claim 1, wherein the evaporative heat exchanger assembly includes three evaporative heat exchangers that are each separately feed liquid evaporant.

6. The method as recited in claim 5, wherein controlling evaporant flow includes shutting off flow to one of the three evaporative heat exchangers and adjusting a flow rate of evaporant based in the temperature of incoming heat transport fluid at the inlet to produce a desired output temperature of the heat transfer fluid.

7. The method as recited in claim 5, including a fourth evaporative heat exchanger separately controllable from the three evaporators and receiving heat transfer medium once flowed through the three evaporative heat exchangers to provide a further desired heat load turndown.

8. The method as recited in claim 7, wherein evaporant flow to the fourth evaporative heat exchanger is adjusted based on the inlet temperature.

9. The method as recited in claim 1, including a controller for selectively actuating control valves associated with each of the plurality of evaporative heat exchangers to control the flow of liquid evaporant.

10. The method as recited in claim 1, wherein at least one of the plurality of evaporative heat exchangers is of a different capacity than any of the other of the plurality of evaporative heat exchangers.

11. An evaporative heat exchanger assembly comprising:

a plurality of evaporative heat exchanger cores each including an evaporant inlet, an evaporant exhaust, and an inlet for receiving a heat transfer medium, wherein subsequent ones of the evaporative heat exchangers receive heat transfer medium from a preceding one of the plurality of evaporative heat exchangers such that the heat transfer medium flows through each of the plurality of heat exchangers in series;

an evaporant control valve associated with each of the plurality of heat exchangers for controlling evaporant flow;

a variable control valve for controlling evaporant flow to each of the evaporant control valves;

an inlet temperature sensor disposed at the inlet for receiving the heat transfer medium; and a controller for actuating the evaporant control valves and the variable control valve responsive to a temperature of the heat transfer medium measured by the inlet temperature sensor to maintain a desired pressure at the evaporant exhaust of each of the plurality of evaporative heat exchanger to prevent freezing of the evaporant flow within each of the plurality of evaporative heat exchangers.

12. The assembly as recited in claim 11, wherein each of the evaporative heat exchangers includes a heat turndown ratio that are combined to provide an assembly turndown ratio.

13. The assembly as recited in claim 12, wherein the assembly turndown ratio is varied by controlling evaporant flow to each of the evaporative heat exchangers.

14. The assembly as recited in claim 11, including an outlet temperature sensor disposed at an outlet of the heat transfer medium for communicating a temperature of the heat transfer medium to the controller.

15. The assembly as recited in claim 11, wherein each of the evaporative heat exchangers exhausts evaporant to an ambient environment, wherein the ambient environment comprises conditions that causes the evaporant to freeze.

16. The assembly as recited in claim 15, wherein the evaporant comprises water.

17. The assembly as recited in claim 11, wherein at least one of the plurality of evaporative heat exchanger cores is of a different capacity than any of the other of the plurality of evaporative heat exchanger cores.

* * * * *